US006973757B2

(12) United States Patent
Marks

(10) Patent No.: US 6,973,757 B2
(45) Date of Patent: Dec. 13, 2005

(54) DRAIN SYSTEM FOR SCREEN ENCLOSURES

(76) Inventor: Gregory D. Marks, 10102 Oak Bark La., Palm Beach Gardens, FL (US) 33410

( * ) Notice: Subject to any disclaimer, the term of this patent is extended or adjusted under 35 U.S.C. 154(b) by 0 days.

(21) Appl. No.: 10/374,012

(22) Filed: Feb. 25, 2003

(65) Prior Publication Data

US 2004/0163342 A1 Aug. 26, 2004

(51) Int. Cl.[7] ..... E04B 1/70
(52) U.S. Cl. ..... 52/302.1; 49/408
(58) Field of Search ..... 52/302.1, 169.5, 52/209; 49/381, 372, 373, 408; 454/195

(56) References Cited

U.S. PATENT DOCUMENTS 4,235,008 A 11/1980 Meredith
4,490,067 A 12/1984 Dahowski
5,813,169 A 9/1998 Engerman
5,822,934 A * 10/1998 O'Donnell ..... 52/209
5,887,391 A 3/1999 Shoup
6,129,838 A 10/2000 Millner
6,164,361 A 12/2000 Meyer

* cited by examiner

*Primary Examiner*—Milton Nelson, Jr.
(74) *Attorney, Agent, or Firm*—Mark D. Bowen, Esq.; Stearns Weaver Miller Weissler & Alhadeff & Sitterson P.A.

(57) ABSTRACT

A drain system is disclosed for use with aluminum screen enclosures to allow for adequate drainage of surface water accumulating on the deck. A screen enclosure base rail is adapted with at least one section having a one-way drain apparatus through which water and debris may flow. A pivotal door disposed within the drain apparatus functions as a one-way door to allow water to drain from the enclosed area while preventing water and/or animals from entering. The drain system is preferably incorporated into an otherwise conventional screen enclosure base rail at one or more suitable locations to provide adequate drainage, and does not adversely effect installation of the screen enclosure, nor does it effect structural integrity.

7 Claims, 7 Drawing Sheets

DRAIN SYSTEM FOR SCREEN ENCLOSURES

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

This invention relates generally to aluminum screen enclosures, and, more particularly, to structural aluminum rails, of the type commonly used to form screen enclosures, adapted with an integral drain mechanism for allowing water to drain from the enclosed space.

2. Description of the Background Art

Drain systems are commonly used to carry away accumulated water. Certain structures, however, have inherent problems with water drainage. Chief among these structures are aluminum screen enclosures, such as the type often found around pools and patios. Those structures are commonly fabricated with a number of connected extruded structural aluminum members forming a frame to which screen is attached to form a screen enclosure. While aluminum screen enclosures are effective in keeping out insects, leaves, and other debris, they are not weather proof and thus allow water to enter the enclosure through the screen mesh. As a result it is common for water to accumulate inside the enclosure and form a pool of standing water as the aluminum base rails act as a dam thereby preventing the water from draining. Furthermore, people often clean the deck within the enclosed area using a garden hose to wash away debris thereby purposefully introducing water onto the deck surface, which water is often left standing due to inadequate drainage. As should be apparent, it is undesirable to have standing water in a screen enclosure as the water can damage and discolor the deck and surrounding objects, attract insect pests, and/or otherwise become a nuisance that prevents the quiet enjoyment of the enclosed area.

As a direct result of the drainage problem associated with aluminum screen enclosed areas, the background art reveals attempts to provide drainage structures for use in and around screen-enclosed areas. For example, U.S. Pat. No. 4,490,067, issued to Dahowski, discloses a below ground drain and conduit member for draining surface water while doubling as an expansion joint. The drain system may be installed along a wall and/or adjacent to a screen enclosure base rail. Similarly, U.S. Pat. No. 6,129,838, issued to Millner, discloses a drain grate system for installation within a concrete deck, along a periphery of the deck and below the base of a frame structure of the screen enclosure for draining water from the deck surface.

While the above-referenced drain structures are suitable for installation in and around screen enclosures they suffer from a number of inherent disadvantages. Firstly, the installation of screen enclosures is greatly complicated by the requirement for mounting the prior art drain structures in the concrete adjacent to and/or below the frame base rails. In addition, the drain structures disclosed in the prior art have drain capacities that are limited by relatively small openings. Furthermore, since the drain grate openings are relatively small and spaced apart the drains disclosed in the prior art can easily become clogged with debris thereby rendering the drain system ineffective. As a result of these shortcomings and other disadvantages in the art there exists a need for an improved drain system for use with screen enclosures in an around swimming pool and patios.

SUMMARY OF THE INVENTION

The present invention provides a thru-the-rail drain system for use with aluminum screen enclosures to provide for drainage of surface water, dirt, and debris accumulating on the deck. More particularly, the present invention provides a drain channel apparatus adapted for insertion within a notch formed in the lower edge of a new and/or existing screen enclosure base rail. The drain channel includes a one-way door capable of moving between an open configuration wherein water and debris are allowed to exit the enclosed space by passing through the drain apparatus and rail, to a closed configuration wherein access to the enclosed space from the outside is blocked. A plurality of drain channel devices may be installed in spaced relation along any given length of base rail to provide adequate drainage. The drain channel apparatus may be installed in new base rail sections prior to installation and/or may be installed in existing screen enclosures by removing a section of the base rail and replacing the removed section with a section modified to include the drain channel apparatus. The drain system does not adversely effect installation of the screen enclosure, nor does it effect structural integrity.

Accordingly, it is an object of the present invention to provide a drain apparatus for use with screen enclosures.

Another object of the present invention is to provide a drain apparatus for screen enclosures that does not require embedded installation in the concrete deck.

Still another object of the present invention is to provide a one-way drain apparatus that allows water and debris to adequately drain from the enclosed area while preventing anything from entering.

Yet another object of the present invention is to provide a pre-fabricated modular drain apparatus for installation in existing screen enclosures.

These and other objects will become apparent with reference to the following drawings and description.

BRIEF DESCRIPTION OF THE SEVERAL VIEWS OF THE DRAWINGS

For a more complete understanding of the present invention, reference should be made to the following detailed description and the accompanying drawings in which.

DETAILED DESCRIPTION OF THE INVENTION

Figure 2:
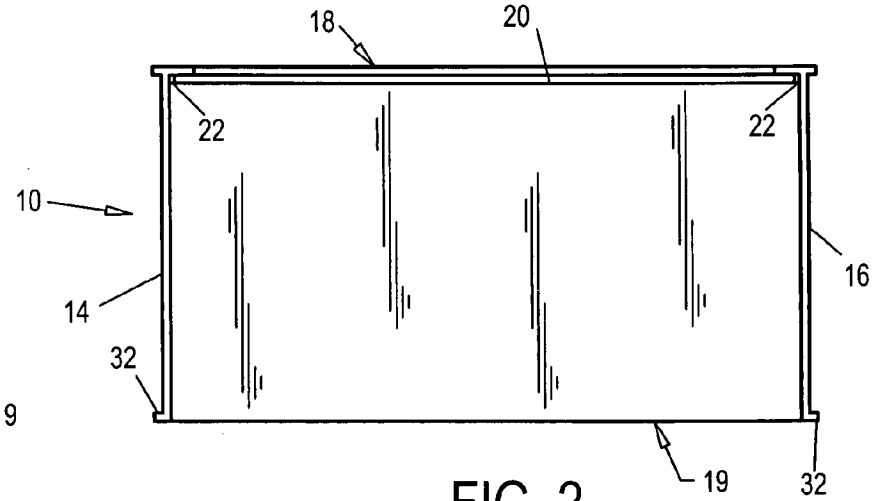
FIG. 2 is a bottom view thereof.
Figure 3:
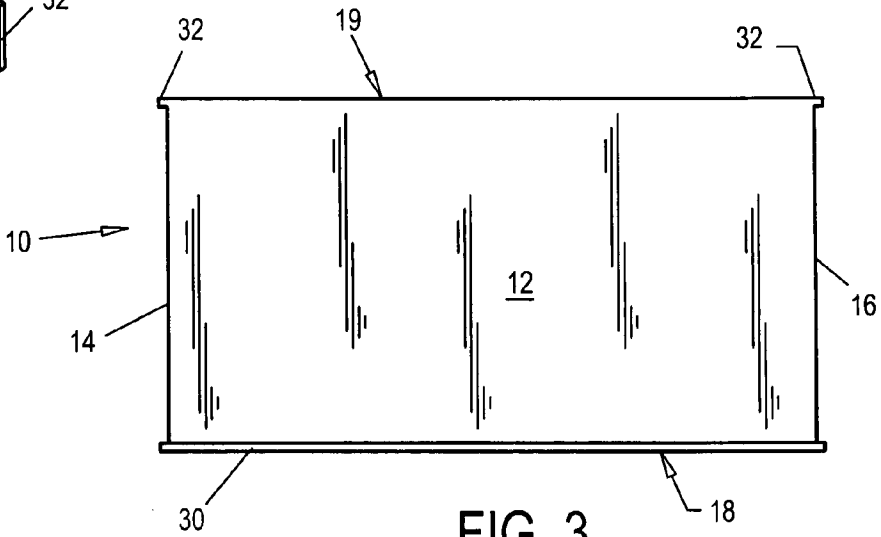
FIG. 3 is a top view thereof.
Figure 1:
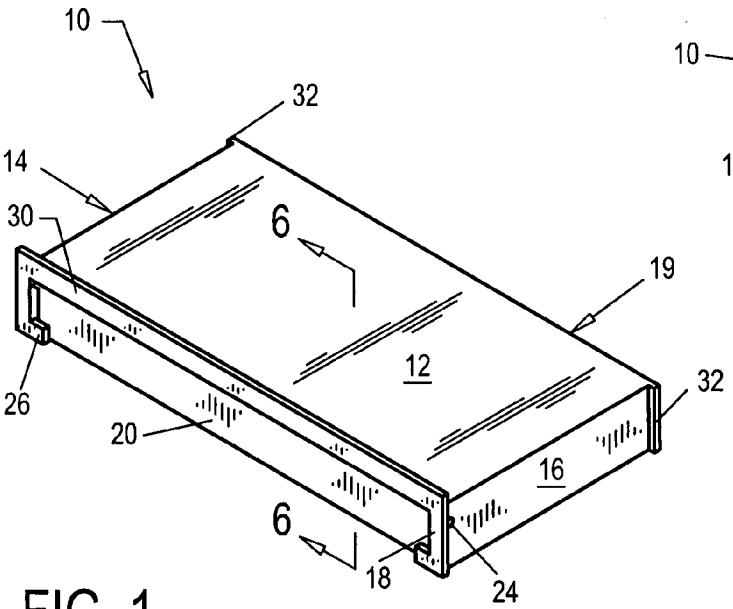
FIG. 1 is a top front perspective view of a one-way drain channel apparatus according to the present invention.
Figure 4:
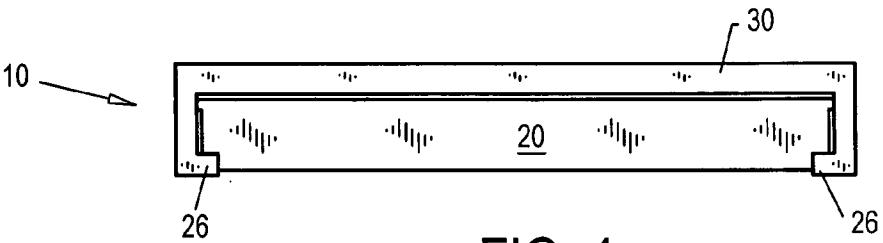
FIG. 4 is a front view thereof.
Figure 5:
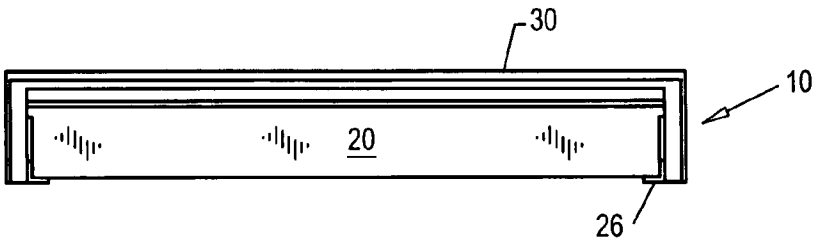
FIG. 5 is a rear view thereof.
Figure 7:
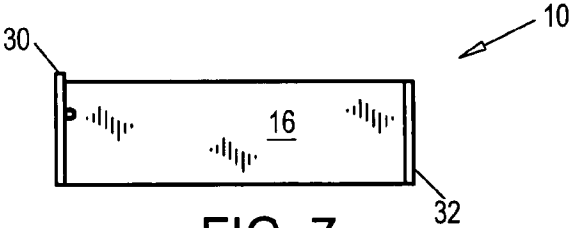
FIG. 7 is a side view thereof.
Figure 6:
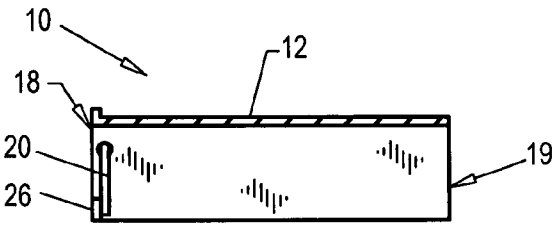
FIG. 6 is a cross-sectional view thereof taken along line 6—6 of FIG. 1.

With reference now to the drawings, FIGS. 1–7 depict a preferred embodiment of a one-way drain channel according to the present invention, generally referenced as 10, for use with base rail members found in screen enclosures. Drain 10 includes a main body having a generally planar top 12, opposing left and right planar side walls, referenced as 14 and 16 respectively, a front 18, a rear 19, and a pivotal flap or door 20. Door 20 is pivotally connected to opposing sides 14 and 16 so as to function as to function as a pivotally opening door. More particularly, door 20 includes laterally projecting members, referenced as 22, disposed proximal the upper edge thereof, which projecting members are received within corresponding apertures 24 defined in each of the side walls 14 and 16. A pair of tabs 26 are defined at the lower front edges of drain 10 and project inward toward the center of the drain channel as best depicted in FIGS. 1 and 4. Tabs 26 are disposed on the front face of the drain and project in front of door 20 thereby preventing the door from opening outward. As should thus be apparent, door 20 is capable of pivotally opening inward toward the drain channel interior, but is prevented from pivotally opening outward by tabs 26. Drain 10 further includes outwardly projecting flanges on the front 18 and rear portions thereof. More particularly, the front portion 18 of drain 10 includes a peripheral flange 30 projecting upward from the top 12 and laterally from opposing sides 14 and 16. Furthermore, the rear portion 19 includes a projecting flange 32 projecting laterally from each side 14 and 16.

Referring to FIGS. 8–11 the drain channel apparatus 10 is specifically adapted for use with a screen enclosure base rail, referenced as 40, of a new and/or existing screen enclosure. Base rail 40 is preferably an elongate, rectangular member having a front surface 42, a rear surface 44, and a top surface 46 and a bottom portion 48. Such base rails are typically formed of aluminum, stainless steel, polyvinyl chloride ("PVC"), or any other suitable material and may be fabricated by extrusion techniques, bending, machining, or any other suitable manufacturing methods. In a typical installation, bottom portion 48 rests on an underlying concrete deck "D", and front surface 42 faces inward toward the enclosed area. The base rail is further adapted for securing screen mesh thereto. More particularly, the rear surface 44 of base rail 40 defines a longitudinal recessed spline groove, referenced as 45. Spline groove 45 is sized for receiving a the peripheral edge of a screen panel and an elongate securing spline cord therein to anchor the screen edge by a press fit connection as is customary in the art.

Figure 8:
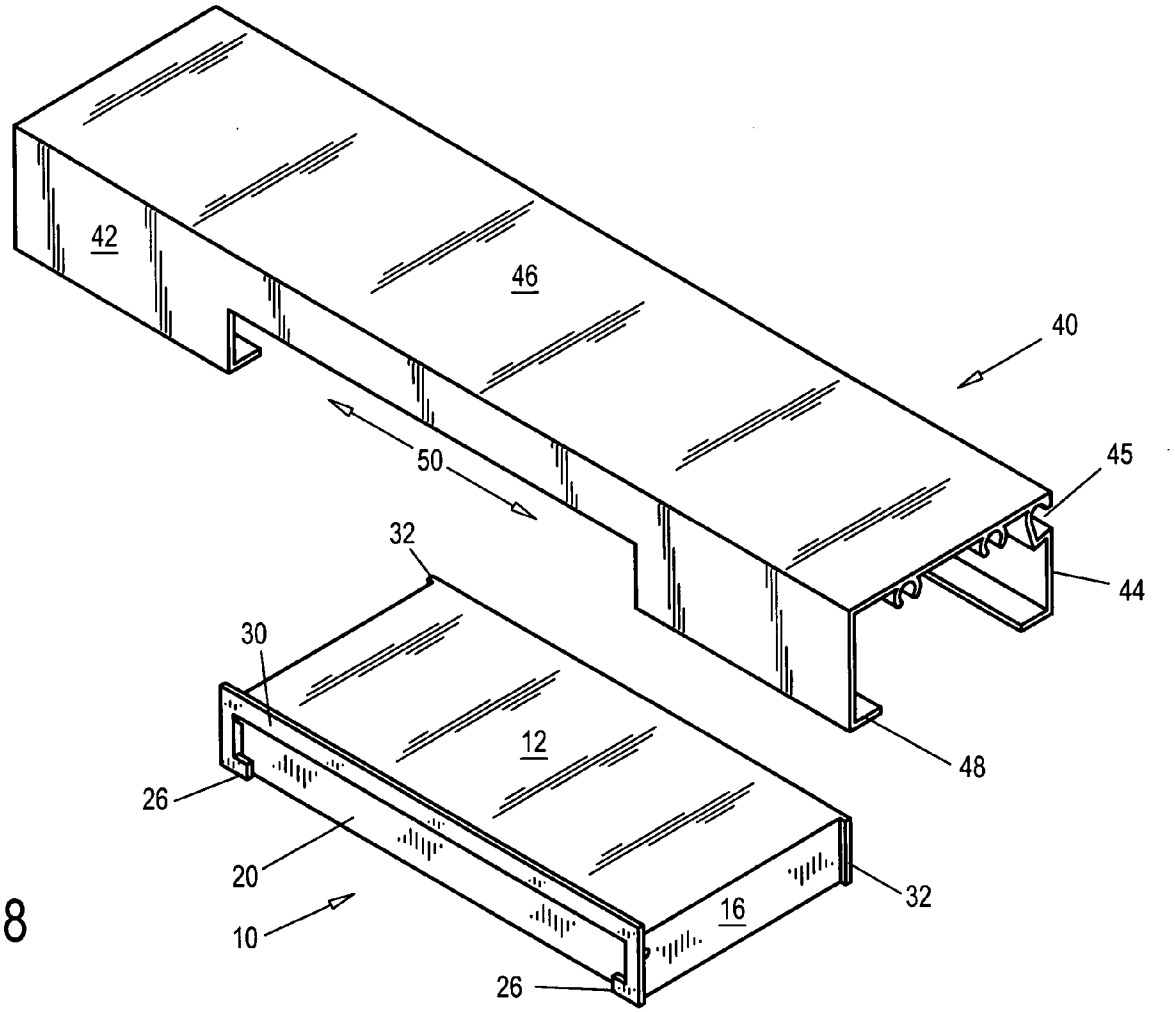
FIG. 8 is an exploded top perspective view of a base rail adapted with a notch and a drain channel apparatus according to the present invention.

The present invention contemplates modification of base rail 40 so as to define an opening, generally referenced as 50, extending completely through rail section 40 by formation of notches on the front surface 42, the bottom 48, and the rear surface 44. When so modified and adapted with a drain channel apparatus of the present invention, opening 50 functions as a drain and/or wash-out for allowing water and debris to exit the enclosed area. Base rail 40 may be modified with a drain channel 10, as depicted in FIGS. 8–10, by the rail manufacturer prior to installation and/or a section of an existing screen enclosure base rail may be removed (by cutting with a hack saw), modified, and reinstalled.

FIGS. 8–11 depict various views of the drain channel apparatus 10 relative to a section of base rail 40 that has been specifically modified with a cut-out opening 50. As noted hereinabove, the drain channel apparatus 10 may be incorporated in base rails by the base rail manufacturer, or, a pre-fabricated base rail section—adapted with the drain apparatus—may be fabricated and sold as a unit for installation in existing screen enclosures. In either case, a section of the base rail is modified with a cut-out area, referenced as 50, corresponding to the width and height of drain channel apparatus 10.

Figure 9:
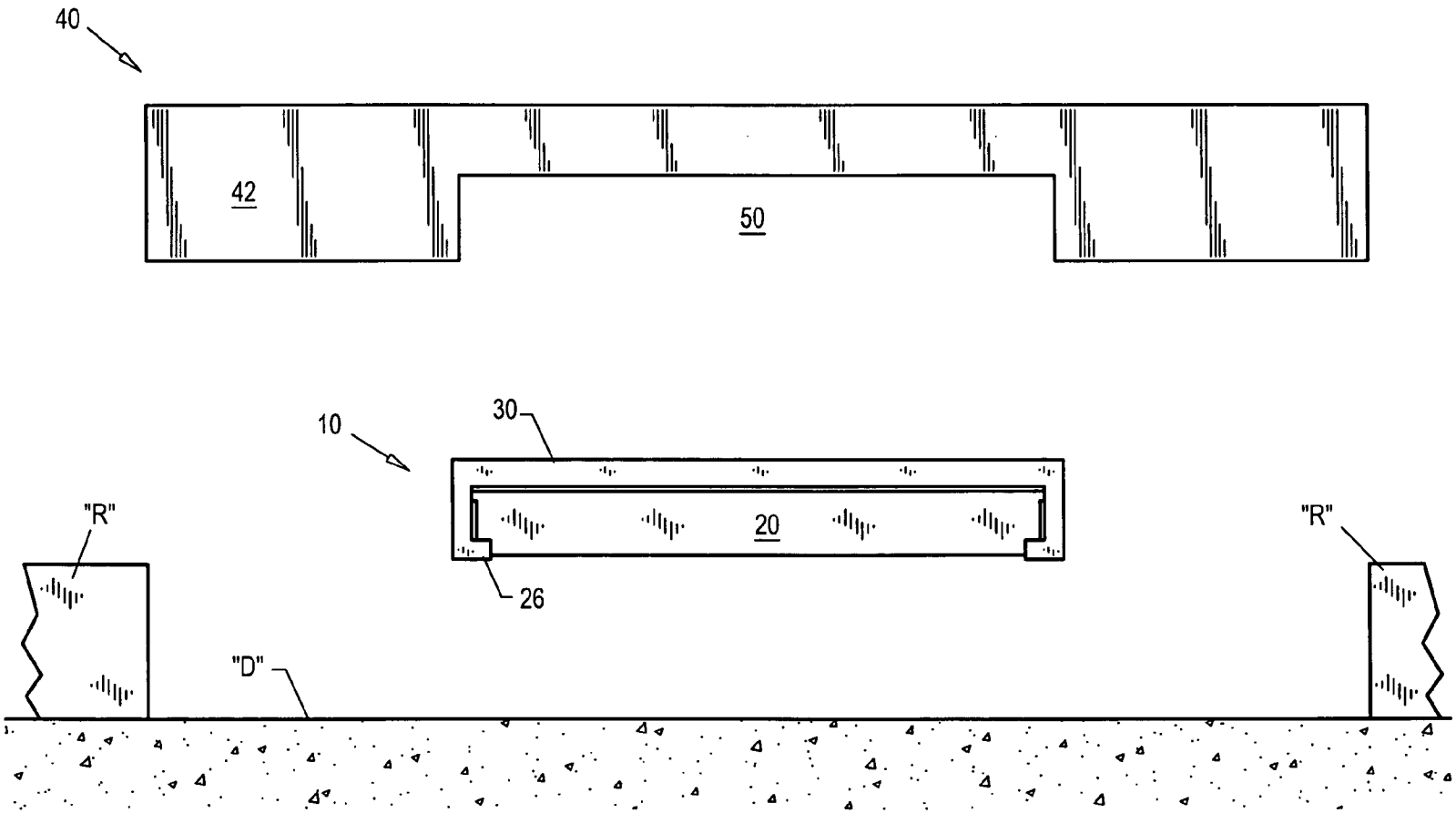
FIG. 9 is a front view thereof relative to a deck and opposing installed base rail sections.
Figure 10:
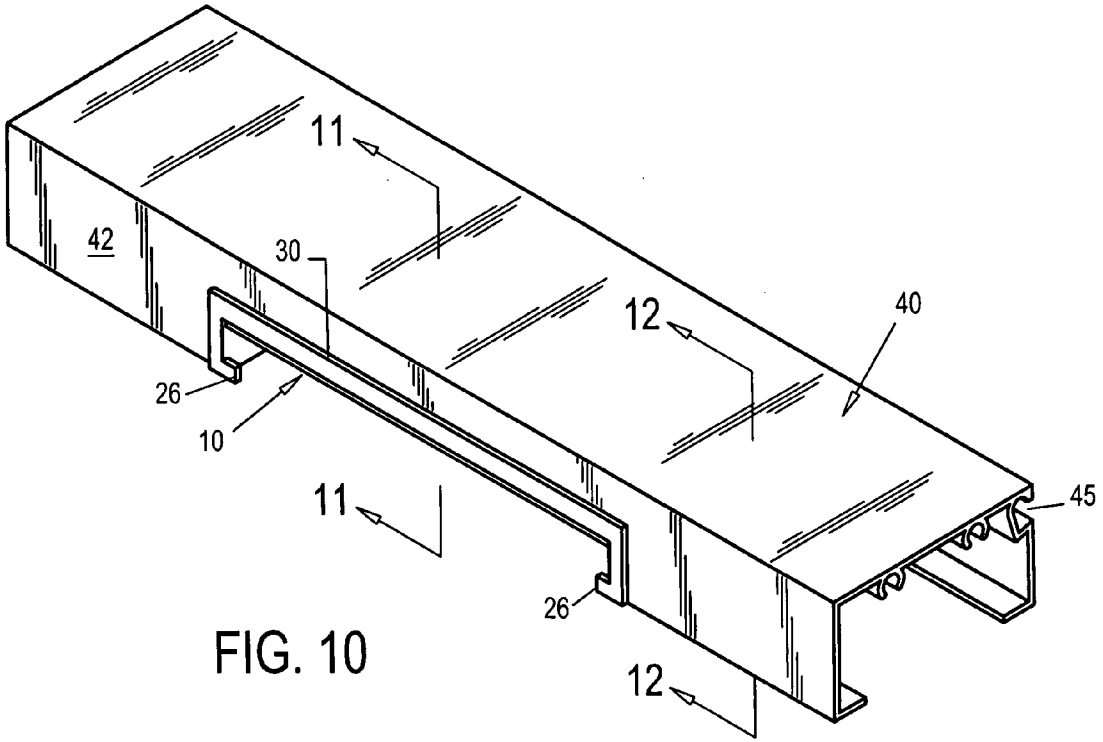
FIG. 10 is a top front perspective view of a base rail section adapted with the drain channel apparatus according to the present invention.
Figure 12:
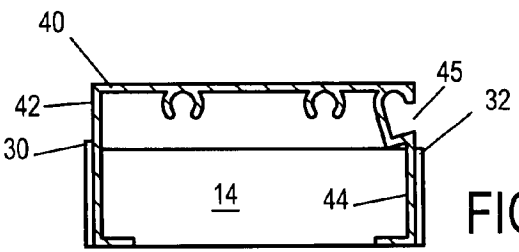
FIG. 12 is a cross-sectional view thereof taken along line 12—12 of FIG. 10.
Figure 11:
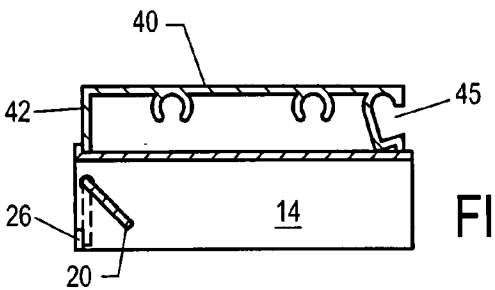
FIG. 11 is a cross-sectional view thereof taken along line 11—11 of FIG. 10.
Figure 13:
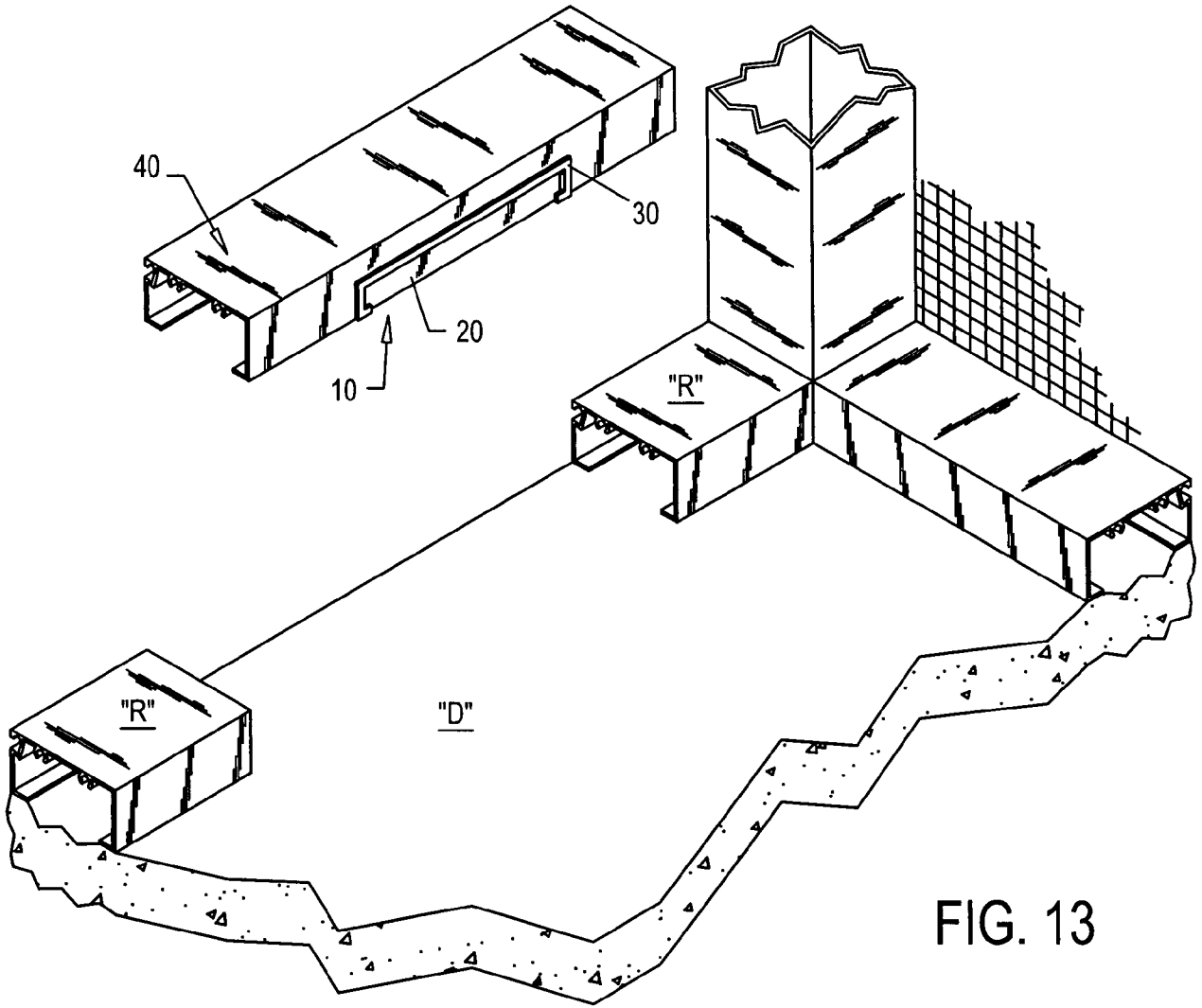
FIG. 13 is a exploded partial top perspective view of a base rail section adapted with the drain channel apparatus according to the present invention relative to other screen enclosure components prior to final installation.
Figure 14:
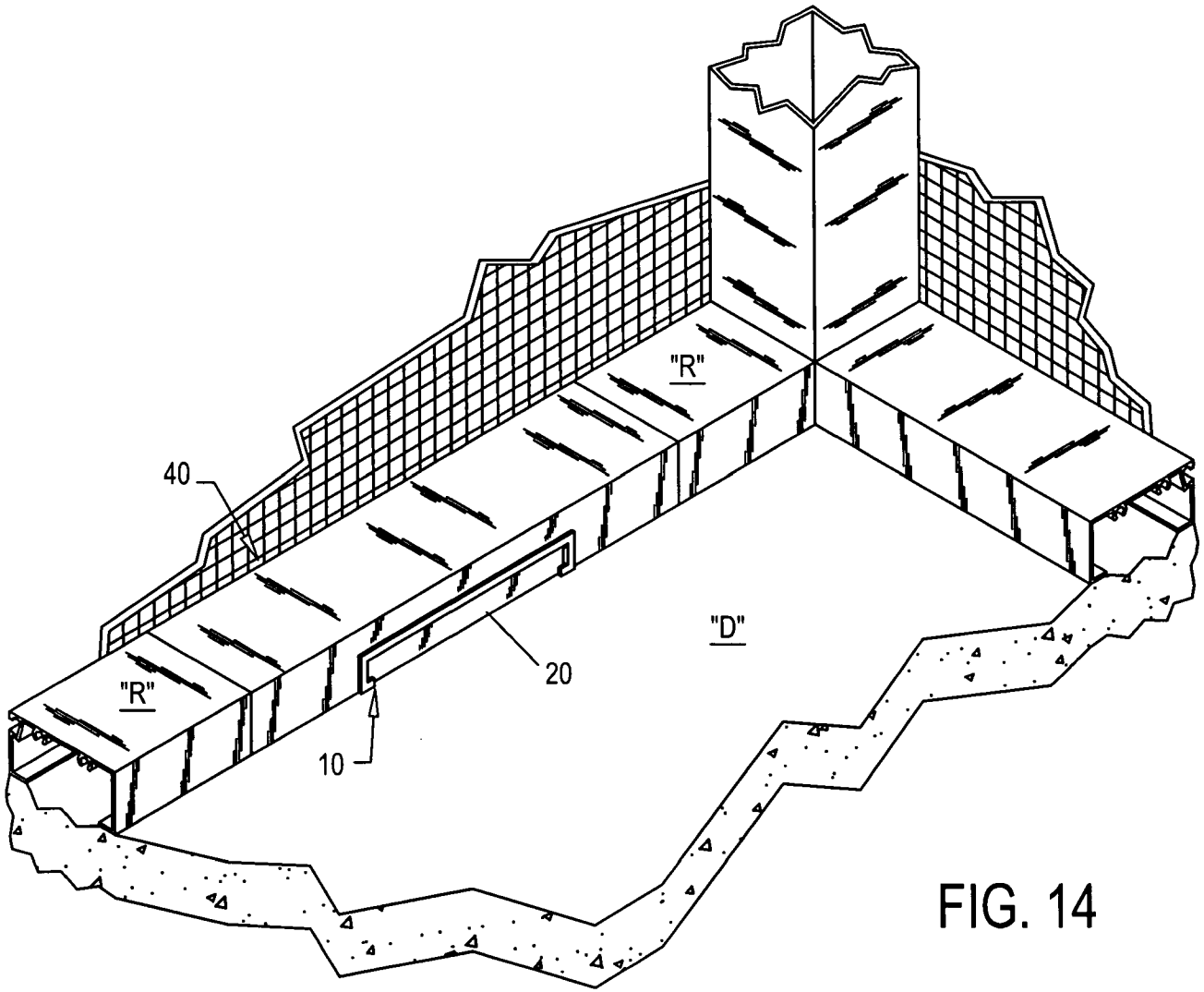
FIG. 14 is a partial top perspective view thereof installed.

FIG. 9 depicts an existing base rail wherein a section, referenced as 40, has been removed leaving terminal ends of the existing base rail, referenced as "R", in place on the supporting deck, referenced as "D". Rail section 40 is further modified to include a cut-out 50 corresponding to the size and shape of drain channel apparatus 10. Drain channel apparatus 10 is then inserted into opening 50 so as to be in mating engagement with rail section 40 as best depicted in FIG. 10. More particularly, rail 40 is insertably sandwiched between the projecting front peripheral flange 30 and projecting rear flanges 32. FIGS. 10–12 depict drain channel 10 installed in base rail section 40. FIG. 11 is a cross-sectional view depicting drain channel 10 relative to base rail 40 after installation with pivotal door 20 depicted in a partially open position (closed position depicted in phantom). FIG. 12 is another cross-sectional view depicting drain channel 10 relative to base rail 40 and illustrates the position of flanges 30 and 32 relative to base rail 40. FIG. 13 depicts a removed base rail section 40, adapted with drain channel 10, relative to the remaining existing frame structure, particularly base rail ends referenced as "R", and the existing deck "D" prior to final installation. FIG. 14 depicts base rail 40 installed back into the base rail structure with screen mesh installed. It should be noted that the front portion 18 of drain channel 10 faces inward toward the enclosed space and the rear portion 19 faces outward.

As noted herein above, a significant aspect of the present invention relates to the drain being a generally a one-way drain. More particularly, door 20 is free to pivot between open and closed positions. In a preferred embodiment door 20 is a one-way door having the capability of opening toward the interior of the rail in a manner that would allow water and debris to exit the enclosed space by passing through the channel, namely through the area defined by top surface 12 and opposing left and right sides 14 and 16. Tabs 26 function as stops to prevent door 20 from pivoting open toward the enclosed space thereby preventing water and debris and/or animals from entering the space through the drain apparatus.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What I claim is:

1. A drain apparatus for use with a structure enclosing a space, said structure having a frame including base rail members, said drain apparatus comprising:

a drain channel adapted for installation in an opening formed in a base rail member, said drain channel defining an inlet and an outlet and an open bottom;

said drain channel adapted for installation in a base rail member such that said inlet is disposed within the enclosed space and said outlet is disposed outside the enclosed space;

said drain channel including a pivotal door positionable between an open configuration wherein an opening is formed between said inlet and said outlet, and a closed position.

2. A drain apparatus according to claim 1, further including stop means for preventing said door from opening in a manner that would allow water and debris to pass from said outlet to said inlet.

3. A water drain for insertion into a mating base rail opening in a screen enclosure constructed of rail members including base rails for enclosing a space, said water drain comprising:

a main body having a front and a back, said main body having generally planar top, opposing left and right planar side walls, said top and said side walls each extending from said front to said back and defining a drain channel with an open bottom;

a door disposed within said drain channel, said door having an upper end pivotally connected to said main body;

said door pivotally movable between a closed configuration wherein said door substantially blocks said channel, and an open configuration wherein said channel is at least partially open whereby water and debris are free to pass through said drain channel.

4. A water drain according to claim 3, further including means for preventing said door from pivoting outward from said main body.

5. A water drain according to claim 4, wherein said means for preventing said door from pivoting outward includes a pair of tabs projecting from said opposing side walls.

6. A water drain according to claim 3, wherein said door is pivotally connected to said main body proximate said main body front.

7. A water drain for insertion into a mating base rail opening in a screen enclosure constructed of rail members including base rails for enclosing a space, said water drain comprising:

a main body having a front end and a back end, said main body having generally planar top and opposing left and right planar side walls, said top and said side walls each extending from said front to said back and defining a drain channel with an open bottom;

a door disposed within said channel, said door pivotally connected to said main body proximate the front end thereof;

a tab projecting in front of said door from each of said opposing side walls;

said door pivotally movable between a closed configuration wherein said door substantially blocks said channel in a generally vertical position, and an open configuration wherein said door pivots inwardly such that the channel is at least partially open whereby water and debris are free to pass through said drain channel.

* * * * *